US007806727B2

(12) United States Patent
Dold et al.

(10) Patent No.: US 7,806,727 B2
(45) Date of Patent: Oct. 5, 2010

(54) PLUG CONNECTOR

(75) Inventors: Roland Dold, Fürtwangen (DE); Werner Rösch, Blumberg (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 12/081,363

(22) Filed: Apr. 15, 2008

(65) Prior Publication Data

US 2008/0261436 A1 Oct. 23, 2008

(30) Foreign Application Priority Data

Apr. 17, 2007 (DE) ..... 10 2007 018 389

(51) Int. Cl.
*H01R 13/40* (2006.01)

(52) U.S. Cl. ..... 439/587; 439/634; 439/518; 439/171; 439/272

(58) Field of Classification Search ..... 439/643, 439/518, 171, 272, 587
See application file for complete search history.

(56) References Cited

U.S. PATENT DOCUMENTS 4,611,875 A * 9/1986 Clarke et al. ..... 439/638
4,973,827 A * 11/1990 Nozaki ..... 219/521
5,425,172 A * 6/1995 Carswell et al. ..... 29/884
5,928,009 A * 7/1999 Lee ..... 439/131
6,039,608 A * 3/2000 Amero et al. ..... 439/651
6,086,395 A * 7/2000 Lloyd et al. ..... 439/172
6,109,927 A * 8/2000 Scholz et al. ..... 439/65
6,733,329 B2 * 5/2004 Yang ..... 439/518
6,991,483 B1 * 1/2006 Milan et al. ..... 439/171
7,040,931 B1 * 5/2006 Achtner et al. ..... 439/651
7,255,567 B1 * 8/2007 Liao ..... 439/11
7,419,393 B2 * 9/2008 Milan ..... 439/171

* cited by examiner

*Primary Examiner*—Truc T Nguyen
(74) *Attorney, Agent, or Firm*—The Nath Law Group; Jerald L. Meyer; Stanley N. Protigal

(57) ABSTRACT

The invention relates to a plug connector (10), in particular, for telecommunications and data-systems-technology connections, comprising a housing in which a connector jack (20) is disposed around which a mating face is disposed, wherein the housing has a front section (44*a*, 44*b*, 44*c*, 44*d*, 44*e*) and a rear section (42), wherein the mating face (30*a*, 30*b*, 30*c*, 30*d*, 30*e*) is disposed on the front section (44*a*, 44*b*, 44*c*, 44*d*, 44*e*), while the connector jack (20) is disposed in the rear section (42) or in the front section (44*a*, 44*b*, 44*c*, 44*d*, 44*e*), and wherein the front section (44*a*, 44*b*, 44*c*, 44*d*, 44*e*) is disposed on the rear section (42) in a detachably connectable manner.

9 Claims, 3 Drawing Sheets

PLUG CONNECTOR

The invention relates to a plug connector having the features specified in the preamble of Claim 1.

Plug connectors are well-known, in particular, for telecommunications and data systems technology, that have a housing in which a connector jack is disposed. In the industrial environment, various mating faces have become established relating to the connector jack, these mating faces meeting various requirements, depending on the application, in terms of shielding, securing the cable inserted into the jack, or safety regulations. Specifically in the case of plug connectors that are permanently installed on a wall or equipment, it is necessary that each of these mating faces have its own housing. This results in a multiplicity of variants for the housing, a situation that entails a significant production cost. Whenever a different mating face is required in actual use, the entire housing must be replaced, thereby further necessitating a high installation cost.

The object of the invention is to provide a plug connector that can be produced inexpensively even for a multiplicity of mating faces.

This object is achieved by a plug connector having the features of Claim 1.

Advantageous embodiments and developments are described in the subordinate claims.

According to the invention, the housing of the plug connector has a front section and a rear section. The mating face is disposed on the front section, while the connector jack is disposed either in the front section or the rear section. The front section and rear section are detachably connectable to each other. This allows the rear section of the housing to be permanently installed, while the front section can be detachably disposed on the rear section. The front section can have different variants in terms of the mating faces. When a different mating face is required in actual use, only the front section with the mating face must be replaced, while the rear section can remain in its original position, in particular, permanently installed. This first of all enables the production cost to be reduced since multiple variants need only be produced for the front section of the housing, while the rear section is on the other hand of identical design for all variants. In terms of installation, it is no longer necessary to remove the rear section from the wall or the equipment, with the result that replacement of the mating face can be effected simply by detaching the detachable connection between the front section and the rear section, and replacing the front section having a first mating face by another front section having a different mating face.

The detachable connection between the front section and the rear section is preferably effected by a detent-locking or clamping mechanism that is very simple to produce and can be easily detached and reconnected by the user.

In an especially preferred embodiment of the invention, locating surfaces for the connector jack are disposed in the front and/or rear section in order to ensure that the connector jack is aligned precisely in one position relative to the mating face when the front section is fitted onto the rear section.

The mating faces can be designed as different variants—for example, as a mating face specified by IEC 61076-3-106 or IEC 61076-3-177, in particular, as a mating face specified by IEC 61076-3-106 variant 1, IEC 61076-3-106 variant 4, IEC 61076-3-106 variant 5, IEC 61076-3-106 variant 6, or IEC 61076-3-117 variant 14.

In an advantageous development of the invention, a seal is disposed between the front section and the rear section so as to ensure that the housing formed by the two sections is watertight or meets other leak-tightness requirements. Preferably, the seal is designed so as to comply with the safety requirements of protection rating IP67.

The connector jack is in particular designed as an RJ45 connector jack.

An embodiment of the invention is described in detail below based on the following figures. Here:

Figure 1:
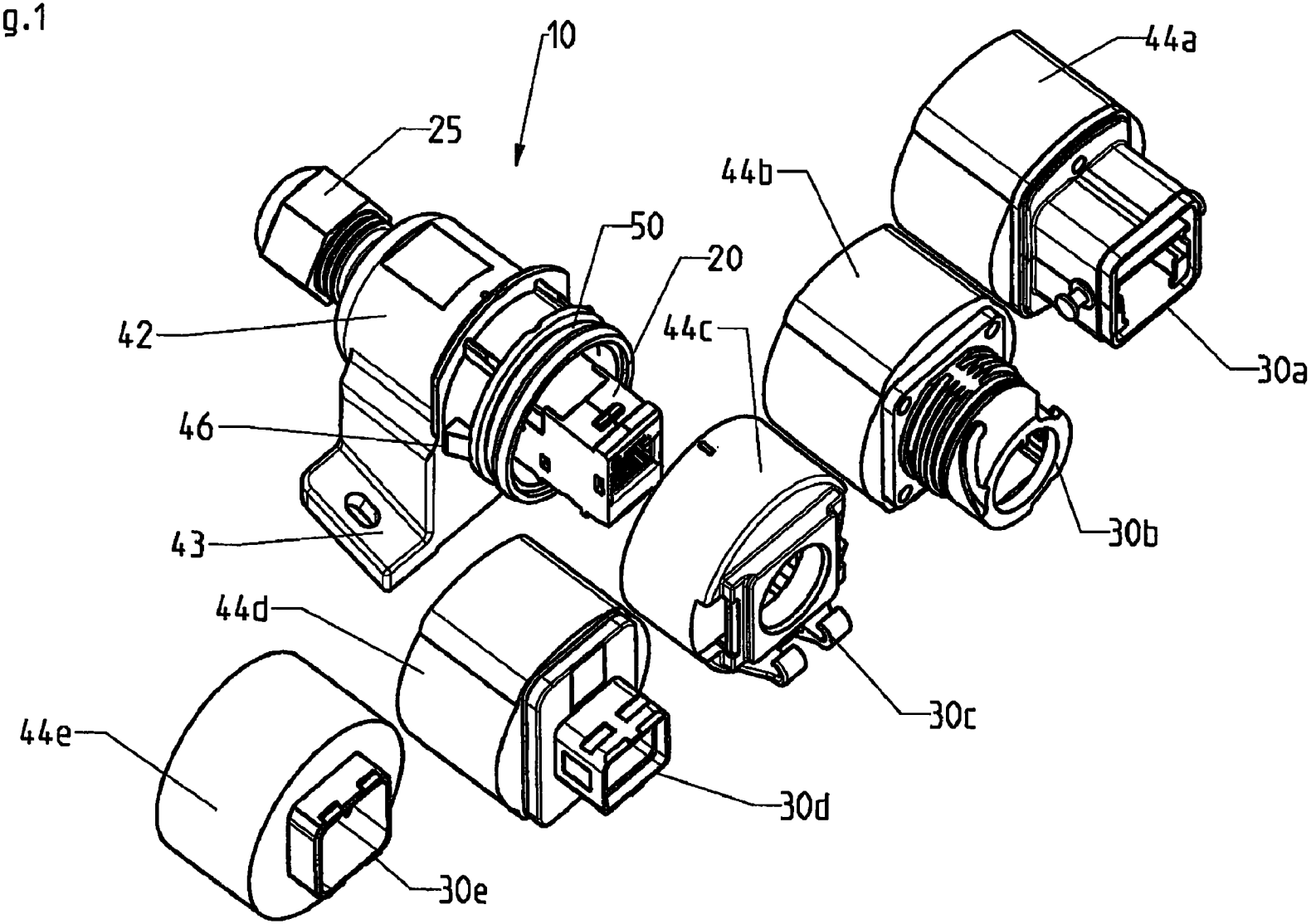
FIG. 1 is a perspective view of a plug connector comprising a rear section and five different variants of a front section.

FIG. 1 shows a plug connector 10 comprising a rear section 42 in which a connector jack 20 is disposed. Connector jack 20 is in particular designed as an RJ45 connector jack. A connection cable of connector jack 20 is sealed and clamped in place by a screwed cable gland 25. An attachment device 43 is disposed on rear section 42, by which device rear section 42 can be permanently mounted on a wall or on equipment. In particular, attachment device 43 has holes through which screws can be inserted so as to allow rear section 42 to be screwed in place on a wall or on equipment.

Together with one of front sections 44*a*, 44*b*, 44*c*, 44*d* or 44e, rear section 42 forms the housing of plug connector 10.

The different variants of front sections 44*a*, 44*b*, 44*c*, 44*d*, 44*e* as illustrated in FIG. 1 differ essentially in regard to the front side which has different mating faces 30*a*, 30*b*, 30*c*, 30*d*, 30*e*.

Mating face 30*a* of front section 44*a* is designed as a mating face specified by IEC 61076-3-106 variant 5. Mating face 30*b* of front section 44*b* is designed as a mating face specified by IEC 61076-3-106 variant 1. Mating face 30*c* of front section 44*c* is designed as a mating face specified by IEC 61076-3-106 variant 6. Mating face 30*d* of front section 44*d* is designed as a mating face specified by IEC 61076-3-106 variant 4, and mating face 30*e* of front section 44*e* is designed as a mating face specified by IEC 61076-3-117 variant 14. Of course, additional mating faces are conceivable.

Rear section 42 together with one of front sections 44*a*, 44*b*, 44*c*, 44*d*, 44*e* forms a closed housing in which connector jack 20 is accessible only through an opening in one of mating faces 30*a*, 30*b*, 30*c*, 30*d*, 30*e*. A seal 50 is disposed between rear section 42 and one of front sections 44*a*, 44*b*, 44*c*, 44*d*, 44*e* in order to form the corresponding housing, for example, in a waterproof manner or to meet current leak-tightness requirements.

Figure 2:
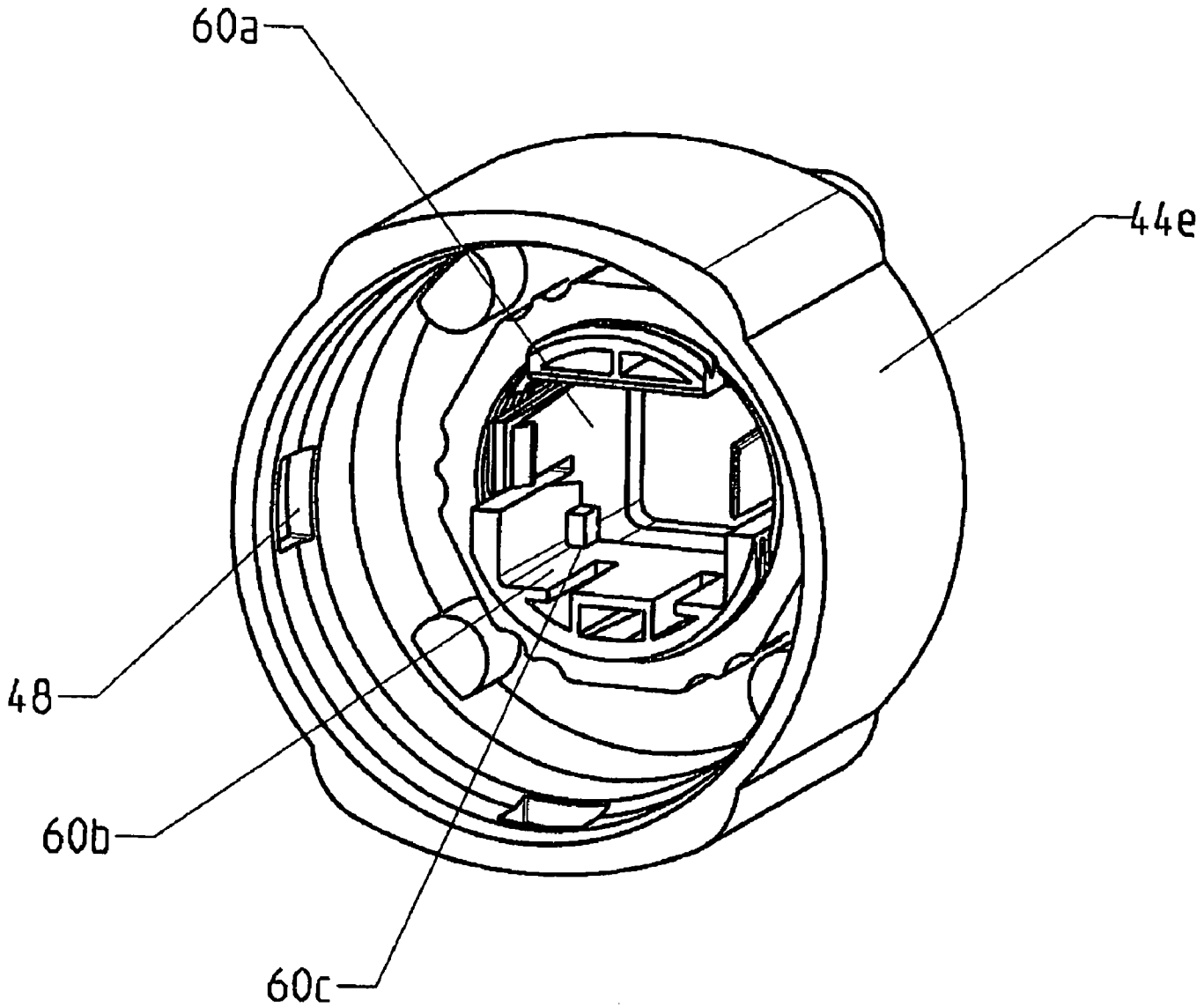
FIG. 2 is a perspective view of a front section.

In order to enable front section 44*a*, 44*b*, 44*c*, 44*d*, 44*e* to be disposed in a detachably connectable manner to rear section 42, detent lugs 46 are disposed on rear section 42, while front section 44*a*, 44*b*, 44*c*, 44*d*, 44*e* has detent recesses 48 (see FIG. 2).

As is evident in FIG. 2 which provides a perspective view of the inside of front section 44*e*, the inner surface of front section 44*e* is equipped with locating surfaces 60*a*, 60*b*, 60*c*. These locating surfaces 60*a*, 60*b*, 60*c* are intended to ensure that connector jack 20 is aligned precisely in a desired position relative to the opening in mating face 30*e*. To this end, what is required in particular is an alignment in three spatial directions. When front section 44*e* is pushed onto rear section 42, locating surface 60*c* forms a stop for connector jack 20, thereby ensuring an alignment in the direction of insertion. Locating surfaces 60*a* and 60*b*, which are essentially perpendicular relative to each other, form a recess together with surfaces running parallel to these locating surfaces, the inside dimensions of the recess roughly corresponding to outside dimensions of connector jack 20 such that connector jack 20 is precisely positioned in front section 44*e*.

Rear section 42 is thus identical for each of plug connectors 10. In addition, rear section 42 can be permanently installed in the desired position by means of attachment device 43. The housing is formed by one of front sections 44*a*, 44*b*, 44*c*, 44*d* , 44*e* being pushed onto rear section 42 and locking into this section as a result of detent lugs 46 engaging detent recesses 48. Of course, other detachable connections, such as, for example, clamping mechanisms or a positive-fitting means are also conceivable. Whenever plug connector 10 is required with a different mating face 30*a*, 30*b*, 30*c*, 30*d*, 30*e*, front section 44*a*, 44*b*, 44*c*, 44*d*, 44*e* must only be replaced by different front section 44*a*, 44*b*, 44*c*, 44*d*, 44*e*. Connector jack 20 is retained in rear section 42 by the connection cable and screwed cable gland 25. Due to the fact that only front section 44*a*, 44*b*, 44*c*, 44*d*, 44*e* is replaced, production costs are reduced, while both the installation and replacement of the mating faces are significantly simplified.

Figure 3:
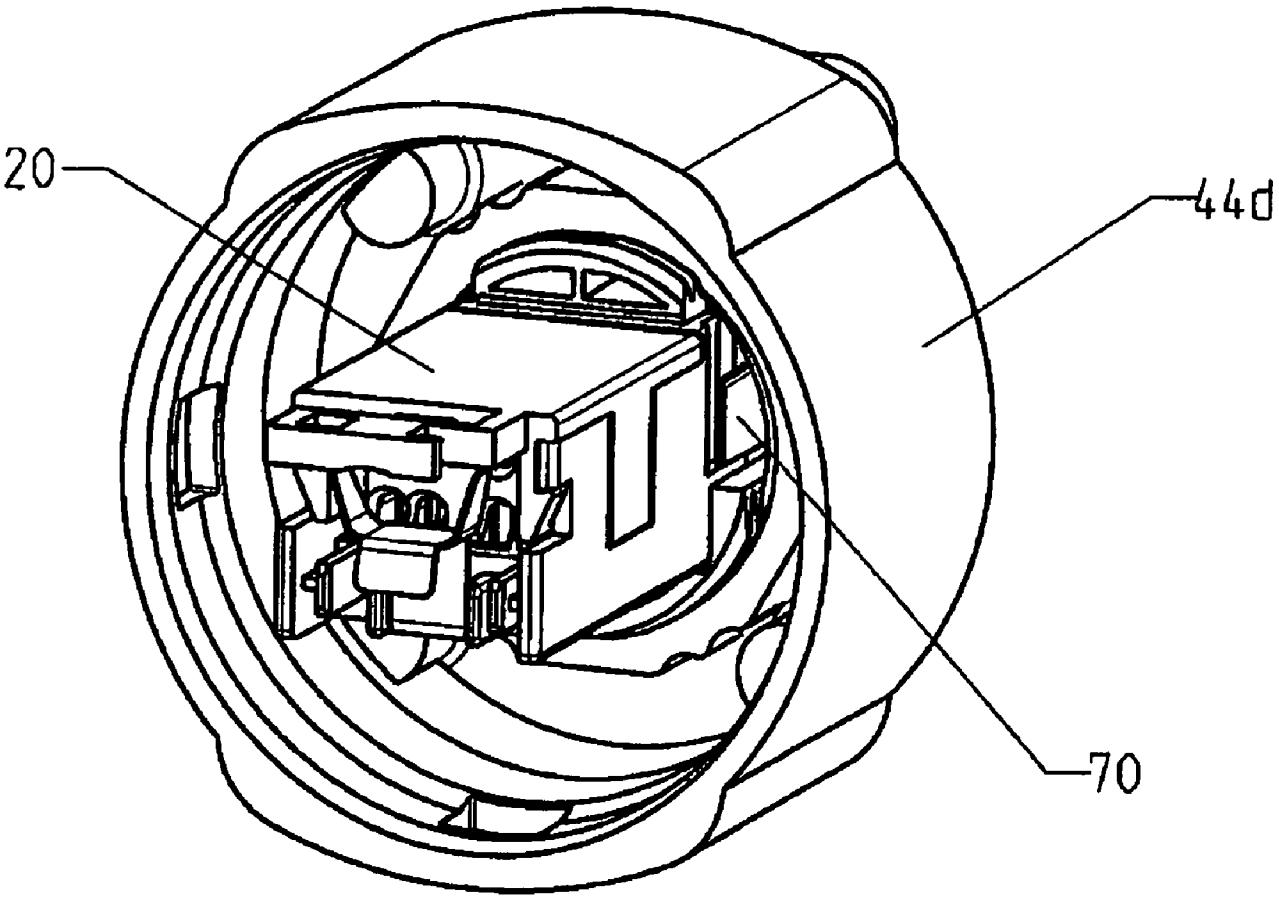
FIG. 3 is a perspective view of a front section of an alternative embodiment.

In one embodiment variant illustrated in FIG. 3, connector jack 20 can also be disposed in front section 44*a*, 44*b*, 44*c*, 44*d* or 44*e*—in the case illustrated in front section 44*e*—for example, by means of locking hooks 70. Connector jack 20 can then be replaced simultaneously with front section 44*a*, 44*b*, 44*c*, 44*d*, 44*e*. In this case, corresponding locating surfaces are disposed in rear section 42, whereby connector jack 20 contacts and is correctly positioned on these surfaces.

LIST OF REFERENCE NOTATIONS

10 plug connector
20 plug connector
25 screwed cable gland
30*a* mating face
30*b* mating face
30*c* mating face
30*d* mating face
30*e* mating face
42 rear section
43 attachment device
44*a* front section
44*b* front section
44*c* front section
44*d* front section
44*e* front section
46 detent lug
48 detent recess
50 seal
60*a* locating surface
60*b* locating surface
60*c* locating surface
70 locking hook

The invention claimed is:

1. Plug connector, in particular for telecommunications and data-systems-technology connections, comprising:

a rear section housing;

a connector jack disposed in the rear section housing;

a front section housing having a mating face, the front section housing mountable on the rear section housing, wherein mounting the front section to the rear section positions the mating face on the front section, with the connector jack disposed in the rear section, the front section disposed on the rear section in a detachably connectable manner, in which the front section housing has a hollow mating face extending through the front section to form a connector in combination with the rear section housing and exposing the connector jack, to use the connector jack disposed in the rear section housing as a termination part of the connector for termination to a mating connector; and a waterproof seal disposed between the front section housing and the rear section housing.

2. Plug connector according to claim 1, characterized in that the front section and the rear section are detachably connectable to each other by means of a detent-locking or clamping mechanism.

3. Plug connector according to claim 1, characterized in that locating surfaces for the connector jack are disposed in the front section.

4. Plug connector according to claim 1, characterized in that the front section has a mating face specified by IEC 61076-3-106 or IEC 61076-3-117, in particular, a mating face (30*b*) specified by IEC 61076-3-106 variant 1, IEC 61076-3-106 variant 4 (30*d*), IEC 61076-3-106 variant 5 (30*a*), IEC 61076-3-106 variant 6 (30*c*), or IEC 61076-3-117variant 14 (30*e*).

5. Plug connector according claim 1, characterized in that the seal meets the safety requirements of protection rating IP67.

6. Plug connector according to claim 1, characterized in that the connector jack is designed as an RJ45 connector jack.

7. Plug connector, in particular for telecommunications and data-systems-technology connections, comprising:

a rear section housing and a connector jack designed as an RJ45 connector jack disposed in the rear section housing;

a front section housing having a mating face, the front section housing mountable on the rear section housing, characterized in that mounting the front section to the rear section positions the mating face on the front section, with the connector jack disposed in the rear section , the front section disposed on the rear section in a detachably connectable manner, in which the front section housing has a hollow mating face extending through the front section to form a connector in combination with the rear section housing and exposing the connector jack, to use the connector jack disposed in the rear section housing as a termination part of the connector for termination to a mating connector; and a waterproof seal disposed between the front section housing and the rear section housing.

8. Plug connector according to claim 7, characterized in that locating surfaces for the connector jack are disposed in the rear section.

9. Plug connector according to claim 1, characterized in that the front section has a mating face specified by IEC 61076-3-106 or IEC 61076-3-117.

* * * * *